US008282364B2

(12) United States Patent
Ogawa et al.

(10) Patent No.: US 8,282,364 B2
(45) Date of Patent: Oct. 9, 2012

(54) ROTARY COMPRESSOR HAVING A MUFFLER WITH A DISCHARGE REGION TO DISCHARGE COMPRESSED GAS TOWARD AN OUTER SURFACE OF THE CRANKSHAFT

(75) Inventors: Ayumi Ogawa, Kusatsu (JP); Hiroyuki Taniwa, Kusatsu (JP); Hirohito Kaida, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 368 days.

(21) Appl. No.: 12/524,061

(22) PCT Filed: Jan. 15, 2008

(86) PCT No.: PCT/JP2008/050315

§ 371 (c)(1),
(2), (4) Date: Jul. 22, 2009

(87) PCT Pub. No.: WO2008/090777

PCT Pub. Date: Jul. 31, 2008

(65) Prior Publication Data

US 2010/0047087 A1 Feb. 25, 2010

(30) Foreign Application Priority Data

Jan. 24, 2007 (JP) ..... 2007-014177

(51) Int. Cl.
*F04B 39/00* (2006.01)

(52) U.S. Cl. ..... 417/312; 181/403

(58) Field of Classification Search ..... 417/312; 181/403

See application file for complete search history.

(56) References Cited

U.S. PATENT DOCUMENTS

| | | | | |
|---|---|---|---|---|
| 4,990,073 | A * | 2/1991 | Kudo et al. | 418/60 |
| 6,287,098 | B1 | 9/2001 | Ahn et al. | |
| 7,229,257 | B2 * | 6/2007 | Ko et al. | 417/312 |
| 2006/0171833 | A1 * | 8/2006 | Sato | 418/60 |
| 2007/0292284 | A1 * | 12/2007 | Morimoto et al. | 417/312 |
| 2008/0003123 | A1 * | 1/2008 | Byun et al. | 418/23 |

FOREIGN PATENT DOCUMENTS

| | | | |
|---|---|---|---|
| CN | 1257164 | A | 6/2000 |
| JP | 58-108291 | U | 7/1983 |
| JP | 63-36090 | A | 2/1988 |
| JP | 02-20796 | U | 2/1990 |
| JP | 05-133377 | A | 5/1993 |
| JP | 2000-18184 | A | 1/2000 |
| JP | 3050198 | B2 | 3/2000 |

OTHER PUBLICATIONS

Office Action of corresponding Chinese Application No. 200880002795.2 dated Aug. 30, 2010.
Notice of Grounds of Rejection of corresponding Japanese Application No. 2009-085749 dated Sep. 13, 2011.

* cited by examiner

*Primary Examiner* — Charles Freay
(74) *Attorney, Agent, or Firm* — Global IP Counselors

(57) ABSTRACT

A rotary compressor includes a rotation compression element, a discharge port and a muffler. The rotation compression element is configured to compress gas as a result of rotation of a crankshaft about a rotation axis. The discharge port is configured to discharge the gas compressed by the rotation compression element. The muffler is arranged to cover the discharge port and surround the crankshaft. The muffler has a muffler crankshaft hole through which the crankshaft passes, and a muffler discharge region configured to discharge the compressed gas discharged from the discharge port toward an outer surface of the crankshaft.

1 Claim, 4 Drawing Sheets

ROTARY COMPRESSOR HAVING A MUFFLER WITH A DISCHARGE REGION TO DISCHARGE COMPRESSED GAS TOWARD AN OUTER SURFACE OF THE CRANKSHAFT

CROSS-REFERENCE TO RELATED APPLICATIONS

This U.S. National stage application claims priority under 35 U.S.C. §119(a) to Japanese Patent Application No. 2007-014177, filed in Japan on Jan. 24, 2007, the entire contents of which are hereby incorporated herein by reference.

TECHNICAL FIELD

The present invention relates to a rotary compressor, and more specifically to an improvement in structure of a rotary compressor.

BACKGROUND ART

<Overall Arrangement of Rotary Compressor>

With reference to FIGS. 3 to 5, an overall arrangement of a rotary compressor will be described. FIG. 3 is a vertical cross-sectional view showing an overall arrangement of a rotary compressor, FIG. 4 is a cross-sectional view taken along a line IV-IV in a direction of arrows in FIG. 3, and FIG. 5 schematically illustrates a flow of compressed gas inside a muffler.

This rotary compressor includes a casing 1, and this casing 1 has a cylindrical shape with its inside being sealed. A compression element 4 is provided on a lower end side, and a drive element 3 for actuating compression element 4 is provided thereabove. A discharge pipe 2 is provided in an upper portion of casing 1. An oil storage 21 for storing a lubricant O is formed in a lower end portion of casing 1, and a storage space 22 for storing compressed gas is formed in other space.

<Compression Element 4>

Compression element 4 includes a cylinder 9 that includes a cylinder chamber 9*a* having a circular transverse cross-sectional shape, and on both upper and lower surfaces of this cylinder 9, a front head 12 having a boss-shaped bearing portion 12*a* at its center and a rear head 13 also having a boss-shaped bearing portion 13*a* at its center are fastened with a plurality of through bolts (not shown), thus putting cylinder chamber 9*a* in a sealed state. A piston 11 is disposed in cylinder chamber 9*a* of cylinder 9. This piston 11 is eccentrically disposed in cylinder chamber 9*a* by a roller 10 of a crankshaft 7.

<Drive Element 3>

Drive element 3 includes an electric motor constituted of a stator 5 and a rotor 8, with stator 5 being fixedly supported to an inner wall surface of casing 1. Rotor 8 is concentrically disposed on the inner side of stator 5 with a prescribed gap 6 in a circumferential direction. An upper half portion of crankshaft 7 is mounted inside rotor 8 around a shaft center to rotate together, and a lower half portion of crankshaft 7 is rotatably supported by fitting and insertion by both bearing portions 12*a* and 13*a* of respective front head 12 and rear head 13. A discharge port 14 provided in front head 12 is provided with a leaf-spring shaped discharge valve 15, to prevent backflow of the compressed gas to cylinder chamber 9*a*.

<Muffler Structure>

A first muffler 16 provided to cover discharge port 14 and surround crankshaft 7 and a second muffler 17 provided to cover first muffler 16 and surround crankshaft 7 are provided around bearing portion 12*a* of front head 12. A rotary compressor having such a double muffler structure is disclosed in Japanese Patent Laying-Open No. 5-0133377.

As shown in FIG. 4, first muffler 16 is provided with a first muffler crankshaft hole 16*h* through which crankshaft 7 and bearing portion 12*a* of front head 12 surrounding crankshaft 7 pass, and first muffler discharge outlets 16*a*, 16*b* disposed symmetrically in a direction displaced from a position of discharge port 14 by 90 degrees around crankshaft 7. Further, second muffler 17 is provided with a second muffler crankshaft hole 17*h* through which bearing portion 12*a* of front head 12 surrounding crankshaft 7 passes, and second muffler discharge outlets 17*a*, 17*b* disposed symmetrically in a direction displaced from the positions of first muffler discharge outlets 16*a*, 16*b* by 90 degrees around crankshaft 7.

As shown in FIG. 5, the compressed gas discharged from discharge port 14 passes through first muffler discharge outlets 16*a*, 16*b* of first muffler 16, and successively passes through second muffler discharge outlets 17*a*, 17*b* of second muffler 17. Accordingly, a two-stage muffling effect by the mufflers (particularly lowering in sound of 800 Hz band) can be expected.

Here, an outer shape of second muffler 17 has a shape of a cup as shown in FIG. 3, and a side surface thereof is constituted mostly of an inclined region. FIG. 6 shows a plan view of second muffler 17, where the inclined region is indicated with hatched lines. Second muffler discharge outlets 17*a*, 17*b* are provided in positions facing each other, and openings thereof are formed to include the inclined portion. This is because if second muffler discharge outlets 17*a*, 17*b* are provided to avoid the inclined region, second muffler discharge outlets 17*a*, 17*b* will have a reduced opening diameter, resulting in an increased discharge pressure loss.

When second muffler discharge outlets 17*a*, 17*b* are formed to include the inclined region in this manner, second muffler discharge outlets 17*a*, 17*b* open partially toward casing 1. As a result, as shown in FIG. 7 which is a cross-sectional schematic view, the compressed gas discharged from second muffler discharge outlets 17*a*, 17*b* is discharged toward casing 1 (a direction of an arrow G1 in the diagram).

Here, the compressed gas discharged from second muffler discharge outlets 17*a*, 17*b* includes not only gas but also lubricant, and the compressed gas and the lubricant are separated from each other while moving to discharge pipe 2 provided in the upper portion of casing 1. Then, as shown in FIG. 7, the compressed gas separated from the lubricant is discharged from discharge pipe 2 (a direction of an arrow G2 in the diagram). On the other hand, the lubricant separated from the compressed gas is returned along the inner wall surface of casing 1 to oil storage 21 (a direction of an arrow O1 in the diagram).

As described above, however, since the compressed gas discharged from second muffler discharge outlets 17*a*, 17*b* is discharged toward casing 1 (the direction of arrow G1 in the diagram), the direction in which the compressed gas is discharged (G1 direction) and the direction in which the lubricant is returned (O1 direction) will collide with each other on the inner wall surface of casing 1. Accordingly, there is apprehension that the return of the lubricant inside casing 1 may be blocked.

SUMMARY OF THE INVENTION

Problems to be Solved by the Invention

A problem to be solved by the present invention is that the discharge direction in which the compressed gas is discharged from the second muffler discharge outlet and the direction in which the lubricant is returned collide with each other on the inner wall surface of the casing, thus blocking the return of the lubricant inside the casing. Therefore, the present invention was made in order to solve the above problem, and to provide a rotary compressor including a second muffler having a discharge outlet structure that allows discharge of compressed gas without blocking a flow of lubricant returned along an inner wall surface of a casing to an oil storage.

Means for Solving the Problems

A rotary compressor based on the present invention includes a rotation compression element for compressing gas by rotation of a crankshaft, a discharge port for discharging the gas compressed by the above rotation compression element, and a muffler provided to cover the above discharge port and surround the above crankshaft, and has the following feature.

The above muffler is provided with a muffler crankshaft hole through which the above crankshaft passes, and muffler discharge regions for discharging, toward an outer surface of the above crankshaft, the compressed gas discharged from the above discharge port.

Effects of the Invention

According to the rotary compressor based on the present invention, the muffler is provided with the muffler discharge regions for discharging the compressed gas toward the outer surface of the crankshaft. By employing an arrangement for discharging the compressed gas toward the outer surface of the crankshaft in this manner, the compressed gas is prevented from flowing to the discharge pipe along the inner wall surface of the casing, and flows to the discharge pipe along the outer surface of the crankshaft and the outside of an electric element. This is because, by discharging the compressed gas toward the outer surface of the crankshaft, the tendency of the compressed gas to flow along the outer surface of the crankshaft and the electric element (the Coanda effect) becomes predominant.

As a result, the flow of the compressed gas toward the discharge pipe is prevented from blocking the flow of the lubricant returned along the inner wall surface of the casing to the oil storage, thereby allowing smooth return of the lubricant along the inner wall surface of the casing to the oil storage.

For example, by employing as a muffler discharge region a notch region extending radially outward from the crankshaft hole when the muffler is viewed two-dimensionally, a discharge area can be sufficiently ensured on an upper planar portion of the muffler, so that the compressed gas can be discharged toward the outer surface of the crankshaft.

DESCRIPTION OF THE REFERENCE SIGNS

1 casing, 2 discharge pipe, 3 drive element, 4 compression element, 5 stator, 7 crankshaft, 8 rotor, 9 cylinder, 9*a* cylinder chamber, 10 roller, 11 piston, 12 front head, 12*a*, 13*a* bearing portion, 13 rear head, 14 discharge port, 15 discharge valve, 16 first muffler, 16*a*, 16*b* first muffler discharge outlet, 16*h* first muffler crankshaft hole, 17, 17A second muffler, 17*a*, 17*b* second muffler discharge outlet, 17*h* second muffler crankshaft hole, 21 oil storage, 22 storage space, n1, n2 notch region.

DETAILED DESCRIPTION OF THE INVENTION

Figure 1:
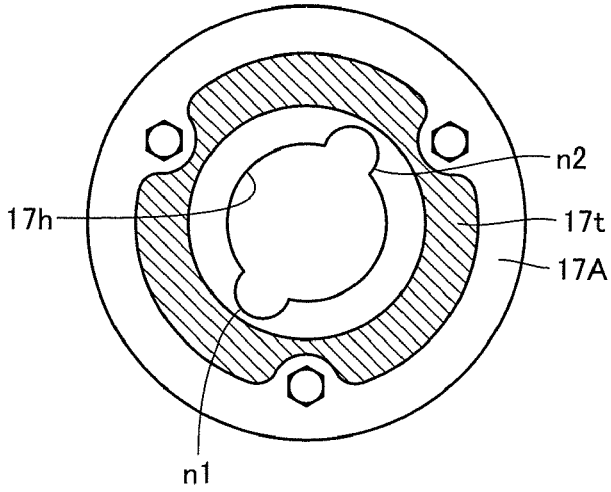
FIG. 1 is a plan view of a second muffler employed in a rotary compressor in an embodiment based on the present invention.
Figure 2:
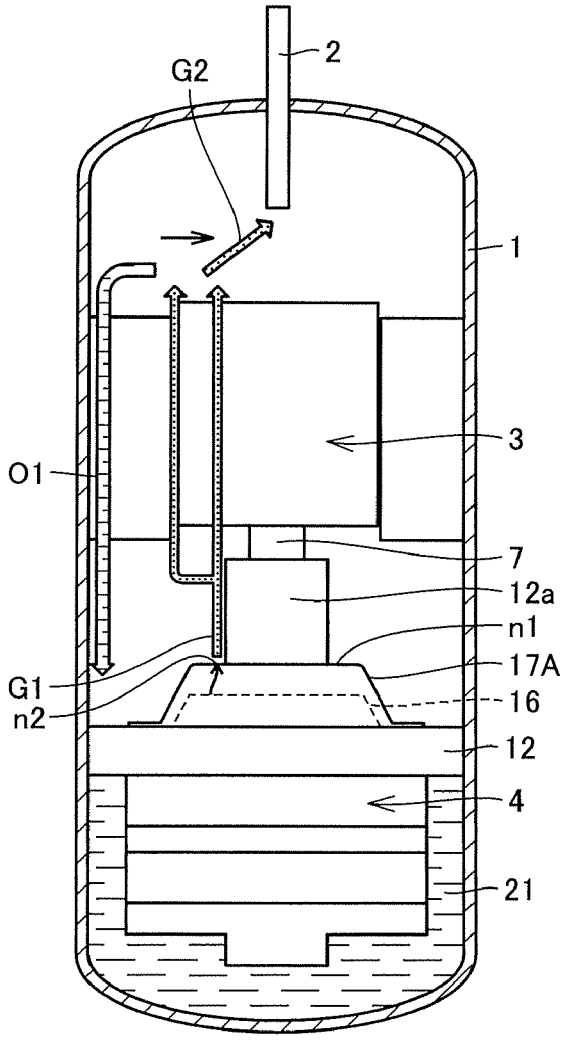
FIG. 2 is a cross-sectional schematic view showing a flow of compressed gas and a flow of lubricant in the rotary compressor incorporating the second muffler in the embodiment based on the present invention.

An embodiment of a rotary compressor based on the present invention will be described below with reference to FIGS. 1 and 2. FIG. 1 is a plan view of a second muffler 17A employed in a rotary compressor in the present embodiment, and FIG. 2 is a cross-sectional schematic view showing a flow of compressed gas and a flow of lubricant in the rotary compressor incorporating second muffler 17A in the present embodiment.

The rotary compressor in the present embodiment has the same basic arrangement as the structure of the rotary compressor having the double muffler structure described with reference to FIGS. 3 and 4, and includes a rotation compression element 4 for compressing gas by rotation of crankshaft 7, discharge port 14 for discharging the compressed gas compressed by rotation compression element 4, first muffler 16 provided to cover discharge port 14 and surround crankshaft 7, and second muffler 17 provided to cover first muffler 16 and surround crankshaft 7.

In addition, first muffler 16 is provided with first muffler crankshaft hole 16*h* through which the above crankshaft 7 passes, and first muffler discharge outlets 16*a*, 16*b* disposed symmetrically in a direction displaced from the position of discharge port 14 by 90 degrees around crankshaft 7.

Figure 3:
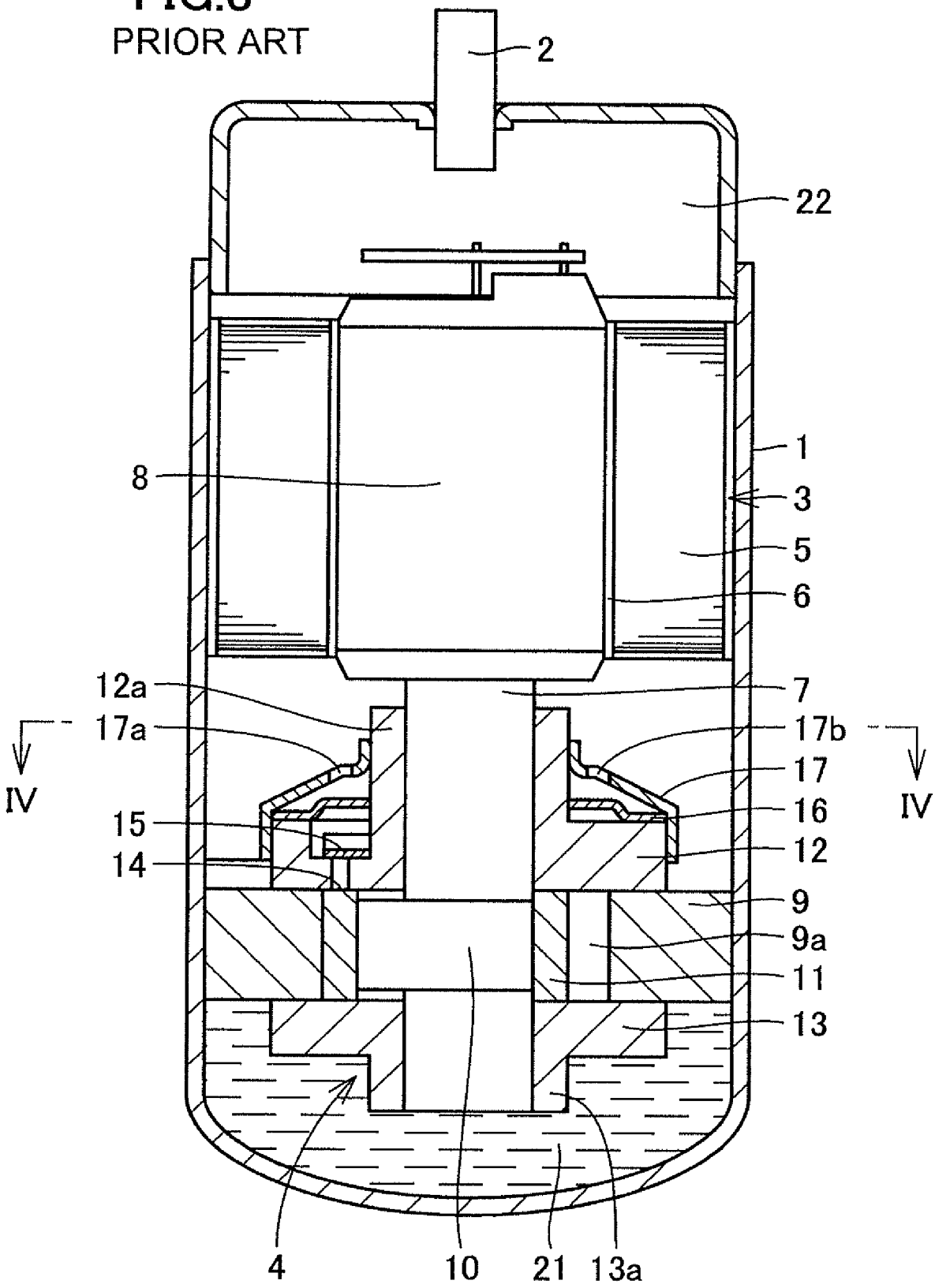
FIG.3 PRIOR ART
FIG. 3 is a vertical cross-sectional view showing a structure of a rotary compressor in background art.
Figure 4:
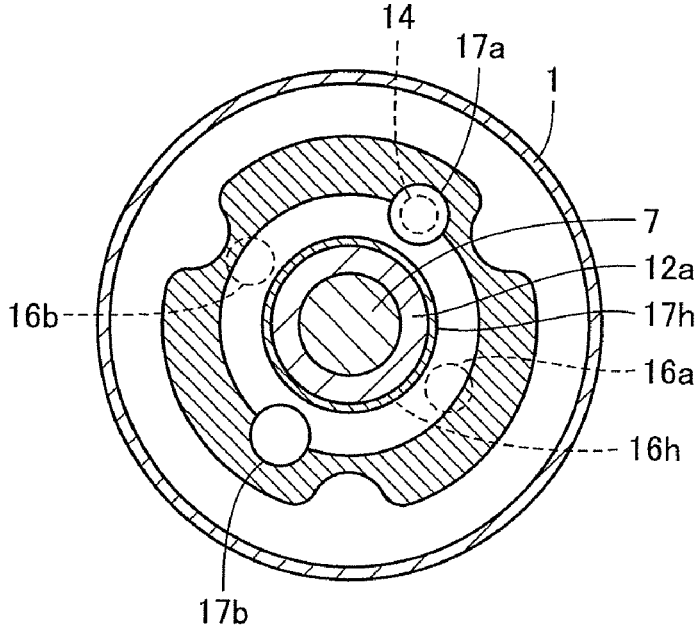
FIG.4 PRIOR ART
FIG. 4 is a cross-sectional view taken along a line IV-IV in a direction of arrows in FIG. 3.
Figure 5:
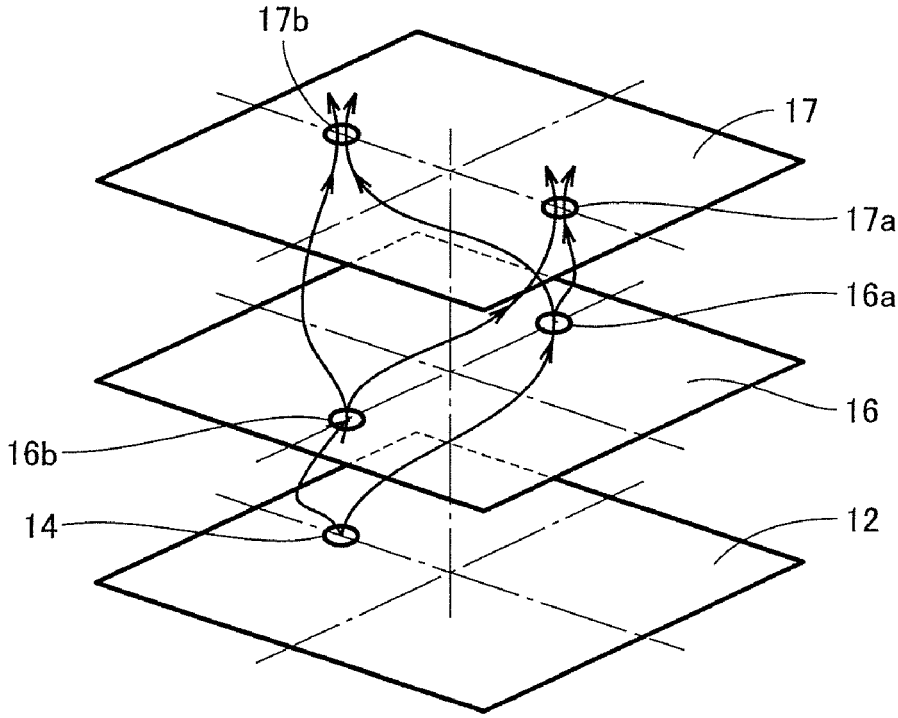
FIG.5 PRIOR ART
FIG. 5 is a schematic view showing a flow of compressed gas inside a muffler.
Figure 6:
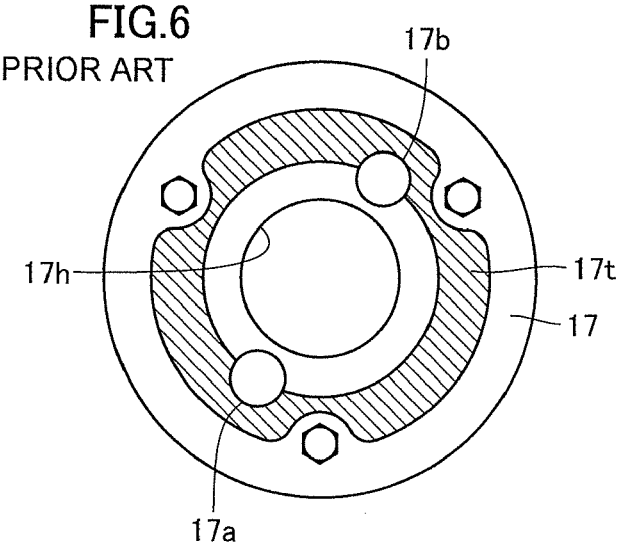
FIG.6 PRIOR ART
FIG. 6 is a plan view of a second muffler in the background art.
Figure 7:
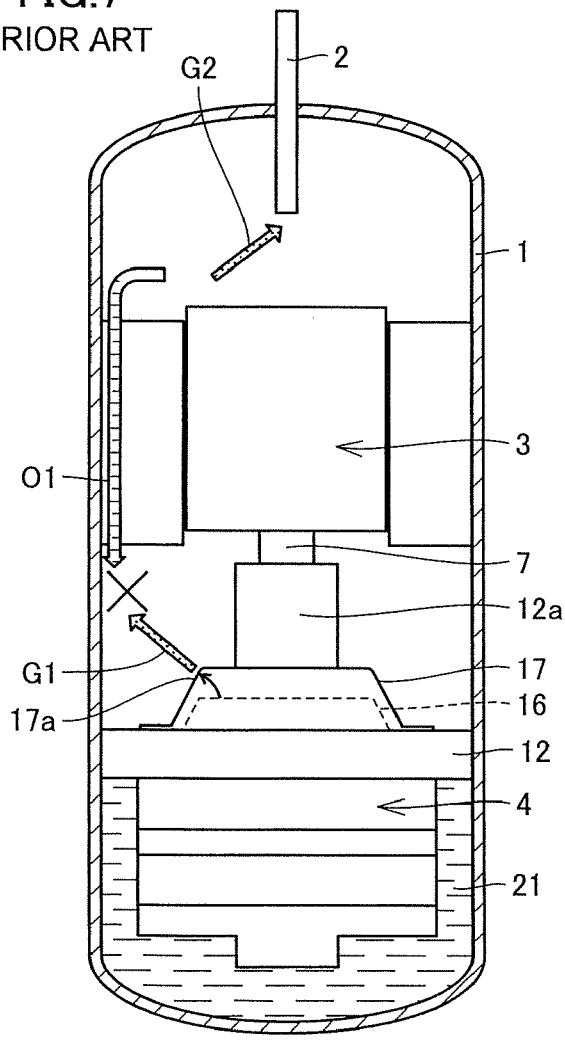
FIG.7 PRIOR ART
FIG. 7 is a cross-sectional schematic view showing a flow of compressed gas and a flow of lubricant in the rotary compressor in the background art.

Thus, in the following description, identical or corresponding parts to those of the rotary compressor having the double muffler structure described with reference to FIGS. 3 and 4 are designated with the same reference signs and a redundant description will not be repeated. Only characteristic features of the present invention will be described below in detail.

First, referring to FIG. 1, second muffler 17A in the present embodiment has a shape of a cup, and includes a second muffler crankshaft hole 17*h* through which crankshaft 7 and bearing portion 12*a* of front head 12 surrounding crankshaft 7 pass, and semi-circular notch regions n1, n2 disposed symmetrically in a direction displaced from the positions of first muffler discharge outlets 16*a*, 16*b* by 90 degrees around crankshaft 7, and extending radially outward from second muffler crankshaft hole 17*h* when second muffler 17A is viewed two-dimensionally.

By providing notch regions n1, n2 extending radially outward from second muffler crankshaft hole 17*h* in this manner, the compressed gas discharged from first muffler discharge outlets 16*a*, 16*b* can be discharged toward an outer surface of crankshaft 7 by an inclined surface 17*t* and semi-circular notch regions n1, n2 provided in second muffler 17A, as shown in FIG. 2 (a direction of an arrow G1 in the diagram).

As a result, the compressed gas moves, based on the tendency to flow along the outer surface of crankshaft 7 (the Coanda effect) (the direction of arrow G1 in FIG. 2), to discharge pipe 2 along the outer surface of crankshaft 7 and the outside of an electric element 3 (a direction of an arrow G2 in FIG. 2).

Therefore, the flow of the compressed gas toward discharge pipe 2 is prevented from blocking the flow of the lubricant returned along the inner wall surface of casing 1 to the oil storage (a direction of an arrow O1 in FIG. 2), thereby allowing smooth return of the lubricant along the inner wall surface of casing 1 to oil storage 21.

Further, in an arrangement provided with the notch regions extending outward from second muffler crankshaft hole 17*h*, a sufficient discharge area (notch area) can be ensured in an upper planar portion of second muffler 17A, so that occurrence of a pressure loss of the compressed gas being discharged can also be suppressed.

Although the present embodiment has been described as employing a semi-circular shape as a shape of the notch regions extending outward from second muffler crankshaft hole 17*h*, the shape of the notch regions is not limited to a semi-circular shape, but various other shapes such as a triangular shape, a polygonal shape and the like can be employed. Any shape will do as long as a region for discharging, along the outer surface of crankshaft 7, the compressed gas discharged from first muffler discharge outlets 16*a*, 16*b* is provided. In addition, the number of notch regions to be provided is not limited to two, but one notch region or three or more notch regions can be provided in accordance with a required muffling effect.

Moreover, while the above embodiment has been described as applying the present invention to a rotary compressor having the double muffler structure, applications of the present invention are not limited to a rotary compressor having the double muffler structure. For example, from the viewpoint of a required muffling effect, even with a rotary compressor employing a single muffler structure, a function and effect similar to that of the above embodiment can be obtained by providing semi-circular notch regions n1, n2 as an example of muffler discharge regions for discharging, toward the outer surface of crankshaft 7, the compressed gas discharged from discharge port 14 provided in front head 12. In addition, the number of muffler discharge regions to be provided is not limited to two, but one muffler discharge region or three or more muffler discharge regions can be provided.

Therefore, it should be understood that the above embodiments disclosed herein are illustrative and non-restrictive in every respect. The technical scope of the present invention is defined by the terms of the claims, and is intended to include any modifications within the scope and meaning equivalent to the terms of the claims.

What is claimed is:

1. A rotary compressor comprising:

a rotation compression element configured to compress gas as a result of rotation of a crankshaft about a rotation axis;

a discharge port configured to discharge the gas compressed by said rotation compression element; and a muffler arranged to cover said discharge port and surround said crankshaft, said muffler having a muffler crankshaft hole through which said crankshaft passes, and a muffler discharge region configured to discharge the compressed gas discharged from said discharge port toward an outer surface of said crankshaft, said muffler discharge region being notch regions disposed symmetrically and extending radially outwardly from said crankshaft hole as said muffler is viewed along said rotation axis, said muffler having an annular circular inclined portion having a conical shape and a muffler inclined surface arranged to discharge toward the outer surface of said crankshaft, and an annular upper planar portion perpendicular to the rotation axis and extending from the annular inclined portion, with said notch regions being provided in said planar portion so as to be spaced radially inwardly from the annular inclined portion.

* * * * *